US005603289A

United States Patent [19]

Kwan

[11] Patent Number: 5,603,289

[45] Date of Patent: Feb. 18, 1997

[54] TEMPERATURE RESPONSIVE PUMP AND FAN FOR AN ENGINE

[75] Inventor: Young-Hae Kwan, Kyungsangnam-do, Rep. of Korea

[73] Assignee: Hyundai Motor Company, Ltd., Seoul, Rep. of Korea

[21] Appl. No.: 493,696

[22] Filed: Jun. 22, 1995

[30] Foreign Application Priority Data

Jun. 22, 1994 [KR] Rep. of Korea ..... 94-14221

[51] Int. Cl.[6] ..... F01P 5/10

[52] U.S. Cl. ..... 123/41.46; 123/41.12

[58] Field of Search ..... 123/41.44, 41.12, 123/41.46

[56] References Cited

U.S. PATENT DOCUMENTS 3,568,647 3/1971 Adams ..... 123/41.12
4,467,747 8/1984 Brantz et al. ..... 123/41.46
4,469,053 9/1984 Sakurai ..... 123/41.12
4,475,485 10/1984 Sakakibara et al. ..... 123/41.44
5,040,494 8/1991 Okita et al. ..... 123/41.46
5,076,216 12/1991 Ro ..... 123/41.46

*Primary Examiner*—Noah P. Kamen
*Attorney, Agent, or Firm*—Birch, Stewart, Kolasch & Birch, LLP

[57] ABSTRACT

A temperature responsive early warm-up device for a vehicle engine, includes an ignition key, an operating switch connected to the ignition switch, an operation releasing switch connected to the ignition key and the operating switch, and a lifting member for a water pump pulley operated by a driving motor for shortening the engine warm-up time so as to save time and fuel, reduce exhaust gas, and extend the lifetime of the vehicle engine.

11 Claims, 3 Drawing Sheets

TEMPERATURE RESPONSIVE PUMP AND FAN FOR AN ENGINE

BACKGROUND OF THE INVENTION

1. Field of the Invention

The present invention relates to an early warm-up device for a vehicle engine and more particularly, to an improved early warm-up device for a vehicle engine for shortening a warm-up period of time, thereby saving time, reducing a fuel consumption ratio and an exhaust gas, and extending the life of the vehicle engine.

2. Description of Related Art

Various types of early warm-up devices for a vehicle engine are known in the art. Some conventional early warm-up devices are described in U.S. Pat. Nos. 3,568,647, 4,469,053, and 4,475,485, and Japanese Patent Laid Open Nos. 55-9766, 58-51370, 59-226224, 60-23459, 63-101504, 2-149728, 5-14564, 6-10157, 6-10158, and Japanese Patent Publication No. 60-1216. Generally, a vehicle should be driven under normal conditions only after the engine is ignited and the engine is warmed up to a certain temperature thereby preventing damage to the engine when generating the original power.

Accordingly, only a short time is required for the engine to warm up in the summer season. In the winter season, however, a long period of time is required for the engine to warm up, for example, about 3 to 5 minutes. Disadvantages in the winter season include delay in warming up the engine and a requirement for extra fuel.

Sometimes, a driver who is pressed for time drives the vehicle before the engine warms up, thereby causing some damage to the engine, thus preventing operation of the engine at full capacity, and shortening the life span of the engine.

SUMMARY OF THE INVENTION

Accordingly, it is an object of the invention to provide a temperature responsive pump and fan for a vehicle engine, which eliminates the above problems encountered with the conventional warm-up devices for a vehicle engine.

Another object of the present invention is to provide an improved temperature responsive pump and fan for a vehicle engine, which includes an ignition key connected to a battery and a fuse, an operation switch connected to the ignition key and a driving motor for placement in an off-position when the coolant is below a certain temperature, an operation releasing switch connected to the ignition switch, the operation switch and the driving motor, and a lifting member of a water pump pulley operated by the driving motor whereby the temperature responsive pump and fan device shortens the warm-up time of the vehicle engine, saves fuel by the empty revolution of the engine, reduces the exhaust gas, and extends the life of the engine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a temperature responsive pump and fan for a vehicle engine, which includes an ignition key, an operating switch connected to the ignition key, an operation releasing switch connected to the ignition key and the operating switch, and a lifting member for a water pump pulley operated by a driving motor for shortening the engine warm-up time, thereby saving time and fuel, reducing exhaust gas, and extending the life of the engine.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
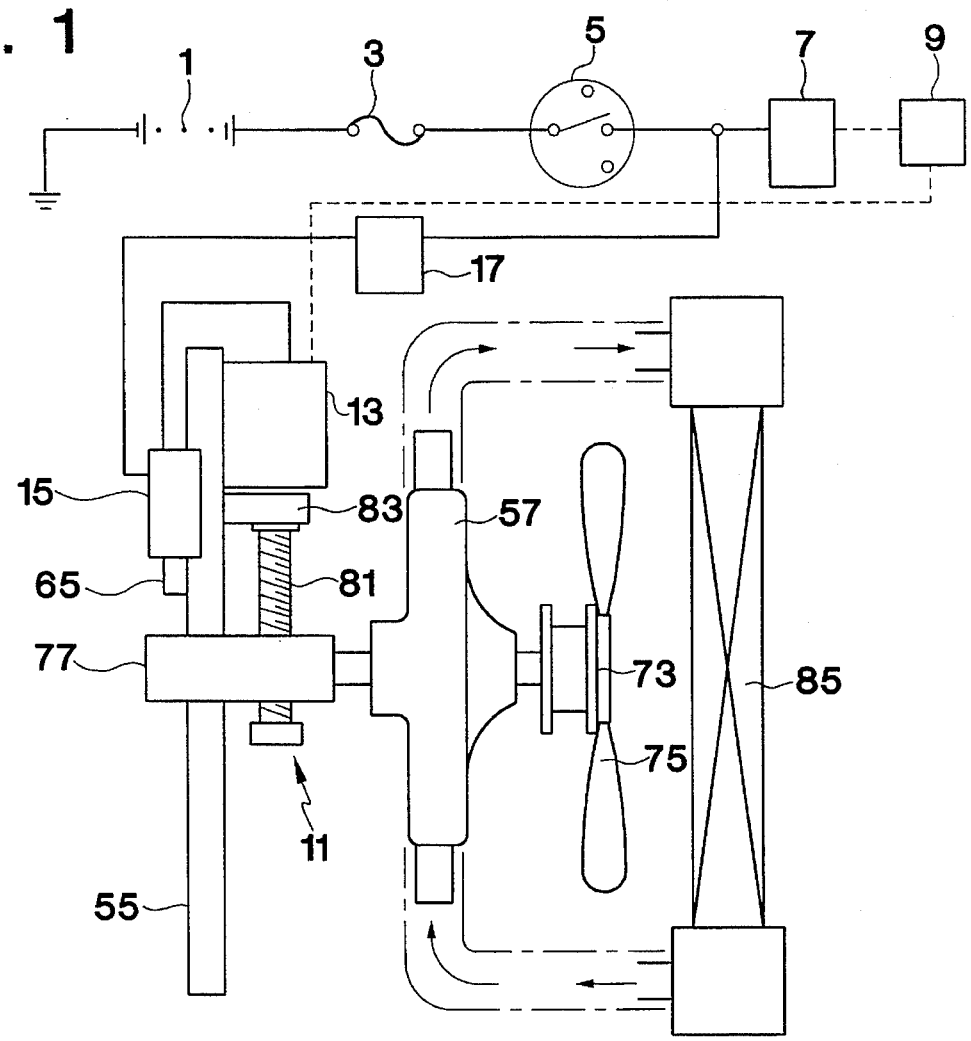
FIG. 1 diagrammatically shows a temperature responsive pump and fan for a vehicle engine according to the present invention.

Referring now in detail to the drawings for the purpose of illustrating preferred embodiments of the present invention, the temperature responsive pump and fan for a vehicle engine as shown in FIG. 1 comprises an ignition key 5, an operating switch 7 connected to the ignition key 5 for operating in response to a coolant temperature, an operation releasing switch 17 connected to a driving motor 13, the ignition key 5 and the operating switch 7, and a water pump ascending and descending member 11 connected to the driving motor 13 for bi-directionally positioning a water pump 57.

The ignition key 5 is linearly connected to a fuse 3. The operating switch 7 is connected to the driving motor 13 of the water pump ascending and descending member 11 through a relay 9. The operation releasing switch 17 is connected to a bridge line which connects to the ignition key 5 and the operating switch 7.

The operating switch 7 only operates over a certain temperature of about 75° C.–85° C. of the coolant and transfers the electric power to the relay 9 to prevent overloading.

Figure 3:
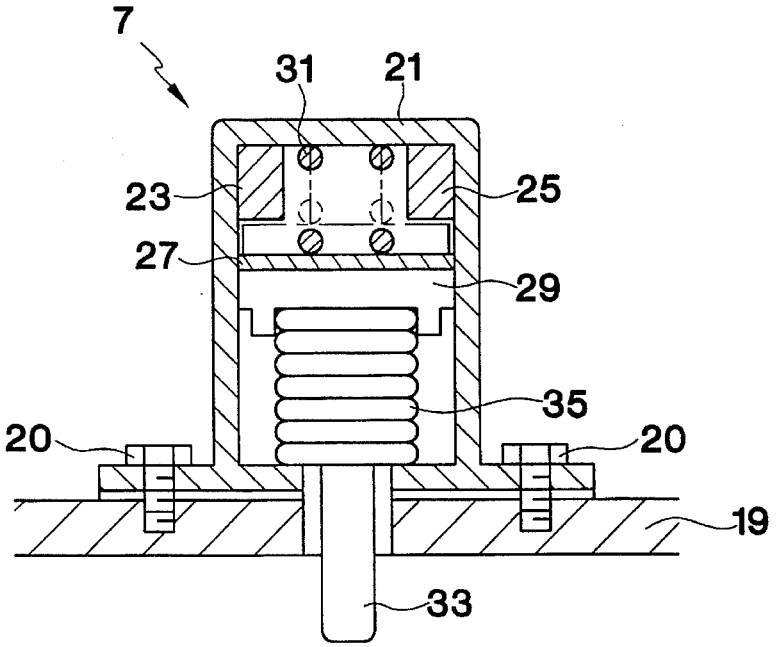
FIG. 3 is a sectional view of an operating switch of the temperature responsive pump and fan according to the present invention.

As shown in FIG. 3, the operating switch 7 includes a first housing 21 attached with bolts 20 to an engine block 19. A first input terminal 23 and a first output terminal 25 are disposed in upper sides of the first housing 21, and a resilient member 31 is disposed at the center of the first housing 21. A first moving terminal 27 is attached to the bottom of the resilient member 31. The resilient member shown in FIG. 3 is a spring, however, any suitable resilient member may be used. The first moving terminal 27 includes a first ascending and descending plunger 29 attached to the bottom thereof and a first bellows 35 tightly disposed within the bottom of the descending plunger 29.

A first projection 33 is attached to the bottom of the bellows 35 for seating into the coolant (not shown). Accordingly, the first projection 33 expands and contracts in response to the temperature of the coolant. Usually, when the temperature of the coolant is over about 75° C. to 85° C., the first bellows 35 expands, and the first ascending and descending plunger 29 and the first moving terminal 27 rise up. Therefore, the moving terminal 27 connects the first input terminal 23 to the output terminal 25 thereby transferring the electric power to the relay 9.

However, when the temperature of the coolant is below the predetermined temperature of 75° C. to 85° C., the projection 33 and the bellows 35 do not expand and the ascending and descending plunger 29 move down. Therefore, the first moving terminal 27 descends and separates from the first input and first output terminals 23 and 25, so that both terminals 23 and 25 are electrically isolated from each other. At this time, the electric power is interrupted between the relay 9 and the operating switch 7.

Figure 4:
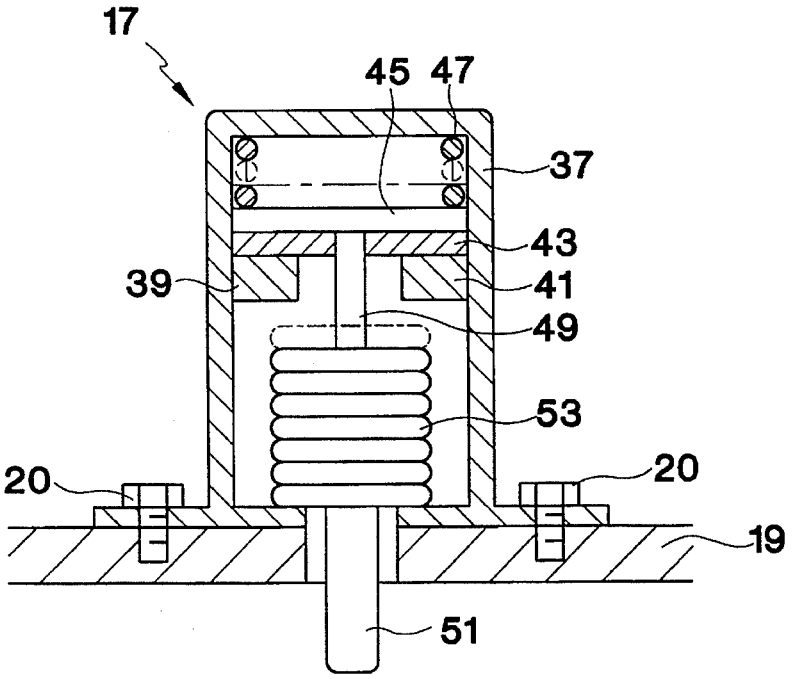
FIG. 4 is a sectional view of an operation releasing switch of the temperature responsive pump and fan according to the present invention.

As shown in FIG. 4, the operation releasing switch 17 includes a second housing 37 attached with bolts 20 to the engine block 19. The second housing 37 contains a second input terminal 39 and a second output terminal 41 both disposed at a mid-section on the inner sides of the second housing 37. A second moving terminal 43 is operatively located on both input and output terminals 39 and 41, and is connected to a connecting rod 49 extending from a second projection 51. A second ascending and descending plunger 45 is attached to the top of the second moving terminal 43. A second resilient member 47 such as a spring is disposed between the second ascending and descending member 45 and the top of the second housing 37. A second bellows 53 surrounds the top portion of the second projection 51. Further, the second projection 51 is seated into the coolant (not shown).

Accordingly, when the temperature of the coolant is below a predetermined temperature of about 75° C. to 85° C., the ascending and descending plunger 45 pushes against the bellows to compress the same because the force of the second resilient member 47 is greater than the expansion force in the bellows 53. Therefore, the second moving terminal 43 electrically connects the second input terminal 39 to the second output terminal 41 for transferring the electric power to the operation releasing switch 17.

However, when the temperature of the coolant is over the predetermined temperature of 75° C. to 85° C., the second bellows 53 expands. Therefore, the ascending and descending plunger 45 pushes against and compresses the second resilient member 47 because the expansion force of the bellows 53 is greater than the biasing force of the resilient member 47. The second moving terminal 43 is thereby separated from the second input and output terminals 39 and 41 for interrupting the transfer of electric power from the second input terminal 39 to the second output terminal 41.

Figure 5:
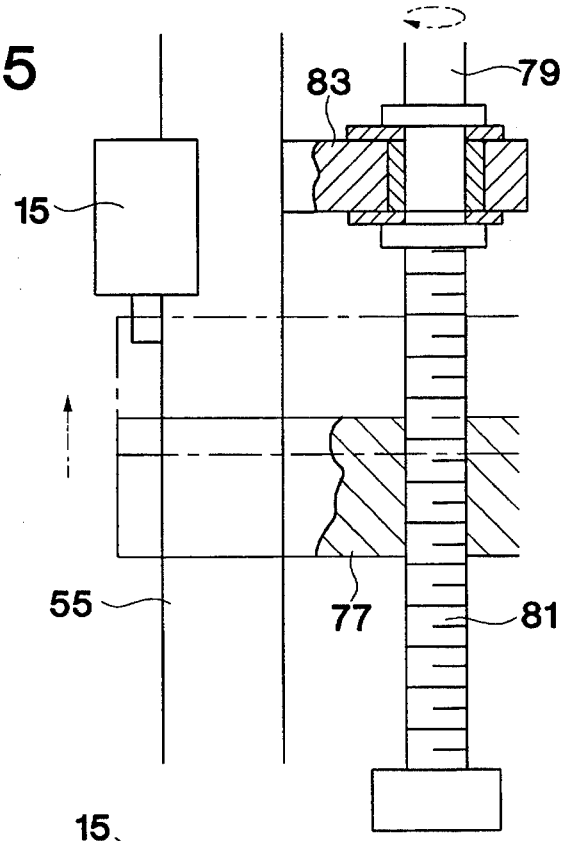
FIG. 5 is a sectional view of a forward drive controlling switch of the temperature responsive pump and fan according to the present invention.
Figure 6:
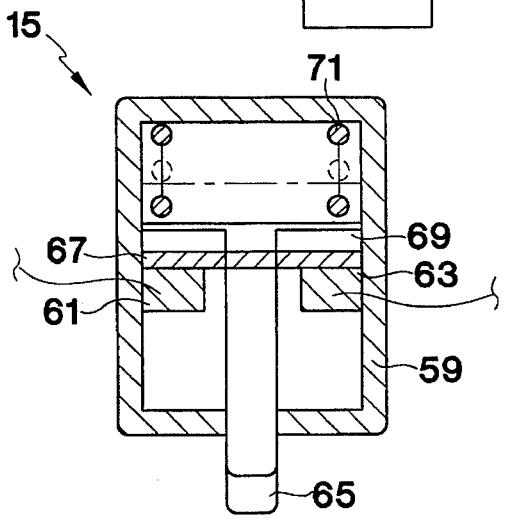
FIG. 6 is an enlarged sectional view of a driving member of a water pump of the temperature responsive pump and fan according to the present invention.
Figure 7:
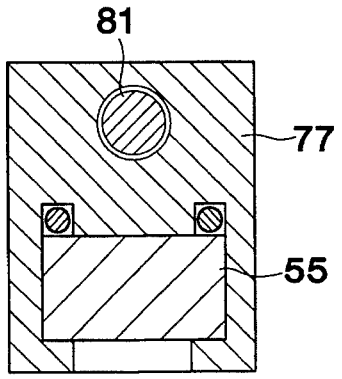
FIG. 7 is a cross-sectional view of the temperature responsive pump and fan according to the present invention.

As shown in FIGS. 5, 6, and 7, an operation controlling switch 15 is located on a supporting rail 55 of the water pump ascending and descending member 11 for restricting the lift of the water pump 57 and receiving the electric power from the operation releasing switch 17.

As shown in FIG. 6, a third input terminal 61 and a third output terminal 63 are disposed below a mid-section and on both sides of a third housing 59. A third plunger 69 is provided with an operating rod 65 attached thereto for vertically moving up and down and a third moving terminal 67 attached to the bottom of the third plunger 69 for operatively connecting to both third input and output terminals 61 and 63. A third resilient member 71 such as a spring is located on the top of the third plunger 69 for biasing the third plunger 69 downward.

As shown in FIGS. 1 and 5, the driving motor 13 includes an ascending and descending member 77 vertically movable with respect to the supporting rail 55. The ascending and descending member 77 is fixed to the water pump 57. The water pump 57 includes a water pump pulley 73 and a plurality of cooling fans 75. The driving motor 13 has a motor shaft 79 extending to a threaded screw rod 81 (FIG. 1).

Accordingly, in response to the direction of the driving motor 13, the ascending and descending member 77 ascends or descends and the water pump 57 ascends or descends. Upward movement of the ascending and descending member 77 is controlled by the position of the member 77 via the operating rod 65 of an operation controlling switch 15.

As shown in FIGS. 1 and 5, the threaded screw rod 81 is rotatably supported to a supporting member 83. The water pump 57 is connected to a radiator 85 at the lower portion thereof and is connected to the vehicle engine at the upper portion thereof.

Figure 2:
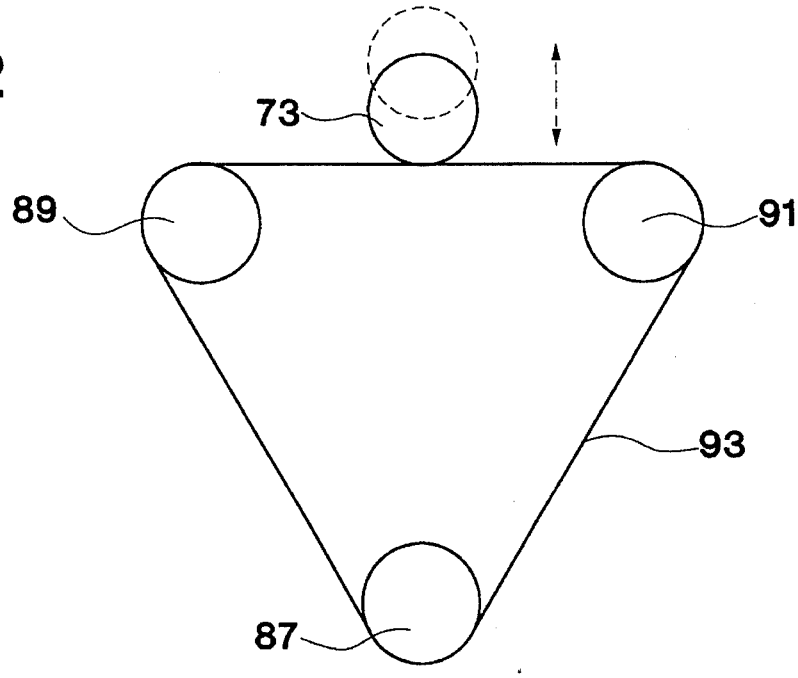
FIG. 2 is a cross-sectional view of a water pump pulley of the temperature responsive pump and fan according to the present invention.

As shown in FIG. 2, the water pump pulley 73 is provided with a crank pulley 87 and left and right idle pulleys 89 and 91 disposed at the upper and both sides of the crank pulley 87. A belt 93 connects the pulleys 87, 89, 91 to each other. Accordingly, if the water pump pulley 73 moves down and contacts the belt 93, the water pump pulley 73 rotates and operates the cooling fans 75 for ventilating the air through the radiator 85.

The temperature responsive pump and fan, according to the present invention, operates as follows. First, the water pump pulley 73 is selectively operated in response to the temperature of the engine coolant. When the temperature of the coolant is below 75° C. to 85° C. at the start of ignition, the operating switch 7 is placed in an off-position because of contraction of the first and second bellows 35 and 53. Simultaneously, the operation releasing switch 17 is in an on-position and the electric power of a battery 1 having a fuse 3 associated therewith, actuates the driving motor 13 through the operation controlling switch 15.

Thereafter, the driving motor 13 rotates in the same direction, moving the ascending and descending member 77 upward, as indicated by the arrow in FIG. 5. At this time, as shown in FIG. 2, the water pump pulley 73 separates from the belt 93 thereby deactivating the cooling fans 75. The air is prevented from ventilating through the radiator 11 and the coolant warms up, thereby warming up the vehicle engine.

In the above situation, an increase of the coolant temperature causes the bellows 35 and 53 to expand and the plungers 29 and 45 to move up, thereby placing the operation switch 7 in an on-position and the operation controlling switch 17 in an off-position. Therefore, the electric power is transferred to the driving motor 13 through the relay 9, thereby rotating the driving motor 13 in the opposite direction of the above rotation direction and moving the ascending and descending member 77 downward.

At this time, the water pump pulley 73 contacts the belt 93, enabling the cooling fans 75 to rotate and place the temperature responsive pump and fan of the present invention in an operative cooling condition.

Accordingly, the present invention provides a temperature responsive pump and fan system for warming the coolant of the vehicle engine by deactivating the cooling fans 75 when the coolant is below a certain temperature, and automatically actuating the cooling fans 75 if the coolant is over a predetermined temperature. As a result, the engine warming time is shortened, a consumption ratio of the fuel and the quantity of exhaust gas decreases, and the life of the vehicle engine is extended.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A temperature responsive warm-up device for a vehicle engine having an engine coolant, cooling fans, and an ignition switch, said device comprising:

first means, connected to said ignition switch, for sensing a temperature of the engine coolant;

second means, connected to said ignition switch and said first means for sensing, for sensing a temperature of the engine coolant;

a driving motor operatively connected to said cooling fans;

a water pump interposed between said driving motor and said cooling fans;

an operation controlling switch electrically connected to said second means for sensing and said driving motor;

a bidirectionally movable member connected to said water pump for bidirectionally moving said water pump in association with movement of said member;

a water pump pulley interposed between said water pump and said cooling fans, said water pump pulley selectively engaging said cooling fans in response to movement of said water pump; and means, responsive to a sensed condition of said coolant by said first and second means for sensing, for selectively actuating said movable member thereby correspondingly bidirectionally moving said water pump, whereby when the sensed temperature of the engine coolant is below a predetermined temperature, the water pump moves in a first direction to disengage the water pump pulley and thereby deactivate the cooling fans and when the engine coolant is over the predetermined temperature, the water pump moves in a second direction to engage the water pump pulley and thereby actuate the cooling fans.

2. The warm-up device according to claim 1, wherein the predetermined temperature is about 75° C. to 85° C.

3. The warm-up device according to claim 1, wherein said first means for sensing is an operating switch including a first housing, first input and output terminals disposed in an upper end and at opposing sides of said first housing, a resilient member centrally disposed within said first housing, a movable terminal disposed below said resilient member, an ascending and descending plunger disposed below said movable terminal, a bellows disposed below said ascending and descending plunger and within said housing, and a projection fixed to said bellows and inserted into said engine coolant, said first housing being attached to an engine block, whereby the operating switch actuates or deactivates when the engine coolant is above or below the predetermined temperature, respectively.

4. The warm-up device according to claim 3, wherein said first resilient member is a spring.

5. The warm-up device according to claim 1, wherein said second means for sensing is an operation releasing switch including a second housing, a second resilient member disposed in an upper portion of said second housing, a second ascending and descending plunger disposed below said resilient member, a second movable terminal disposed below said ascending and descending plunger, second input and output terminals disposed below said second movable terminal, a second bellows disposed within a lower portion of said second housing, and a second projection fixed to said second bellows and inserted into said engine coolant, said second housing being attached to the engine block, whereby said operation releasing switch actuates or deactivates when the engine coolant is below or above a predetermined temperature, respectively.

6. The warm-up device according to claim 5, wherein said second resilient member is a spring.

7. The warm-up device according to claim 1, wherein said operation controlling switch receives the electric power from said second means for sensing, and includes a third housing, a third resilient member disposed in an upper portion of said third housing, a third plunger disposed below said third resilient member, a third movable terminal disposed below said third plunger, third input and output terminals disposed below said third movable terminal, and an operation rod fixed to said third plunger thorough said movable terminal for restricting a lifting position of said bidirectionally movable member.

8. The warm-up device according to claim 7, wherein said third resilient member is a spring.

9. The warm-up device according to claim 1, further comprising a supporting rail for vertically and movably receiving said bidirectionally movable member connected to said water pump, and a threaded screw rod rotatably connected to said driving motor for upwardly and downwardly movably receiving said bidirectionally movable member.

10. The warm-up device according to claim 9, wherein said threaded screw rod includes a supporting member for rotatably supporting said threaded screw rod with respect to said supporting rail.

11. A temperature responsive warm-up device for a vehicle engine comprising:

a selectively movable water pump positioned in proximity to a vehicle engine, said water pump including a rotatable water pump pulley;

a belt pulley engageable with the rotatable water pump pulley, for rotating the water pump pulley;

a plurality of fans connected to said water pump and rotatable in response to rotation of the rotatable water pump pulley;

a radiator operatively connected to said water pump, said plurality of fans being positioned between said water pump and said radiator;

means for sensing a temperature of an engine coolant;

means for sensing an ignition condition of said vehicle engine; and means, responsive to the sensed temperature and ignition condition, for selectively moving said water pump and the water pump pulley into engagement with the belt and thereby correspondingly rotating said plurality of fans.

* * * * *